United States Patent [19]

Leishman

[11] Patent Number: 5,020,605

[45] Date of Patent: Jun. 4, 1991

[54] POST DRIVER AND METHODOLOGY

[75] Inventor: Layne S. Leishman, Huntington Beach, Calif.

[73] Assignee: Product Research and Development, Santa Ana, Calif.

[21] Appl. No.: 424,058

[22] Filed: Oct. 19, 1989

[51] Int. Cl.[5] ..... B25D 17/00; E02D 5/22

[52] U.S. Cl. ..... 173/1; 173/30; 405/232

[58] Field of Search ..... 173/1, 30, 128, 170; 405/231, 232, 244; 404/10, 11

[56] References Cited

U.S. PATENT DOCUMENTS

| | | | |
|---|---|---|---|
| 834,866 | 10/1906 | Bern | 405/232 |
| 1,569,857 | 1/1926 | Farb | 405/244 |
| 2,067,890 | 1/1937 | Collord | 405/244 |
| 2,282,049 | 5/1942 | Haggart, Jr. | 405/244 |
| 3,320,714 | 5/1967 | Barrett | 405/231 |
| 3,921,410 | 11/1975 | Philo | 405/232 |

*Primary Examiner*—Douglas D. Watts
*Assistant Examiner*—Scott A. Smith
*Attorney, Agent, or Firm*—Gordon L. Peterson

[57] ABSTRACT

A post driver includes a sleeve for supporting a post as the post is driven into the ground and a driver for driving the post into the ground while the post is supported by the sleeve. The sleeve defines a channel that is dimensioned and arranged to receive the post so that the post can slide through the channel as the post is driven into the ground and the driver is dimensioned and arranged to slide over the sleeve. Preferably, the sleeve extends to the right height above ground and one embodiment includes a spade attached to a lower end of the sleeve for breaking the ground. A method of driving a post into the ground includes the steps of providing a sleeve for supporting the post as the post is driven into the ground and a driver for driving the post into the ground while the post is supported by the sleeve. The user places the post within the sleeve, the driver over the post and the sleeve, and the post and the sleeve in a generally vertical position at a location on the ground where the post is to be driven. The user then operates the driver to drive the post into the ground, preferably breaking the ground first using a spade on the end of the sleeve. Driving the post until the upper end of the post is even with the upper end of the sleeve automatically sets post height.

18 Claims, 2 Drawing Sheets

16
18
11
24
13
17
20
14
23
12
26
27

POST DRIVER AND METHODOLOGY

BACKGROUND OF THE INVENTION

1. Technical Field

This invention relates generally to posts, and more particularly to an apparatus and methodology for driving a flexible post into the ground.

2. Background Information

A flexible post tends to buckle and bend when driven, thereby making installation difficult. It does so all the more when the particular application couples stringent flexibility requirements with installation in hard ground. Nevertheless, flexible posts enjoy widespread use so that the tools and methodology utilized for their installation demand attention.

Consider, for example, a flexible post of the type commonly utilized along the highway. Sometimes called a flexible, highway-delineator guidepost or just guidepost, it may be used to mark such things as the highway edge, the shoulder, or an object or feature of the terrain along the highway. In addition, it may be fabricated and installed according to governmental specifications.

In that regard, typical guidepost specifications such as those issued by CALTRANS of the State of California may require that the guidepost be about five and one-half feet long so that eighteen inches can be driven into the ground with the other four feet remaining above ground. The guidepost specifications may also require that the guidepost be installable by driving it into the ground without the need for a separately prepared pilot hole (i.e., a separate hole-forming tool and hole-forming operation) and that when installed the guidepost be capable of enduring ten hits by an automobile traveling at fifty-five miles-per-hour without failing to come back to within twenty degrees of a vertical position.

Some existing drivers for such guideposts take the form of a conventional fence post driver, employing a heavy steel sleeve that fits telescopingly over the post. The sleeve has an open lower end and a closed upper end, the installer first placing the driver over the guidepost so that the closed end of the sleeve rests upon the upper end of the guidepost and then putting the guidepost in a vertical position where it is to be installed. Next, the installer slides the driver upwardly. Then he slams it downwardly so that the closed end impacts the upper end of the guidepost, the impact driving the guidepost downwardly into the ground.

But installing the guidepost in that manner can damage it. For example, the impact of the driver can cause the guidepost to bend and buckle. In addition, the guidepost may deform sufficiently to get stuck in the driver. Furthermore, since four feet of the guidepost must remain above ground, the driver cannot be more than four feet long and it is usually even shorter. As installation begins, the lower portion of the guidepost is completely uncontained just above ground level so that a failure may result all the more easily. Thus, it is desirable to have a better way of driving a flexible post into the ground.

SUMMARY OF THE INVENTION

This invention solves the problems outlined above by providing a post driver that includes both a containment sleeve and an overdriver, the containment sleeve functioning to support the post as the post is driven into the ground with the driver. Properly configured, the containment sleeve (or just sleeve) and the overdriver (or just driver) provide support to substantially the full length of the post above ground. Thus, the post driver helps prevent buckling and bending. It also helps keep the post from becoming stuck in the driver. It involves easily operated components that work without a separately formed pilot hole, and it can provide automatic height control as subsequently discussed.

Generally, an apparatus for driving a post into the ground that is constructed according to a major aspect of the invention includes means defining a sleeve for supporting a post as the post is driven into the ground and means defining a driver for driving the post into the ground while the post is supported by the sleeve. The sleeve defines a channel that is dimensioned and arranged to receive the post so that the post can slide through the channel as the post is driven into the ground and the driver is dimensioned and arranged to slide over the sleeve in order to drive the post through the channel into the ground.

According to another aspect of the invention, the sleeve may have a length sufficient to extend from the ground to a height to which the post is to be driven. That provides the automatic height control mentioned previously, the installer simply driving the post until the upper end of the post is even with the upper end of the sleeve. According to still aspect, the sleeve can include spade means attached to a lower end portion of the sleeve for enabling a user to break the ground into which the post is to be driven In that regard, the spade means may include a blade member and at least one step member configured for a user to step upon in order to force the blade member into the ground.

According to yet another aspect of the invention, the driver includes means for supporting an upper portion of the post as the post is driven into the ground. That is desirable because initially the upper end of the post extends out of the upper end portion of the sleeve so that it is not supported by the sleeve. Preferably, the driver includes an inwardly extending rib to provide the support, the rib extending toward the post so that it can bear against the upper end portion of the post to provided needed support. In that regard, the sleeve may have a C-shaped cross section so that the rib can extend into the channel when the driver is placed telescopingly over the sleeve.

In line with the above, a method of driving a post into the ground according to the invention includes the step of providing a sleeve for supporting the post as the post is driven into the ground and a driver for driving the post into the ground while the post is supported by the sleeve. The method proceeds by placing the post within the sleeve, placing the driver over the post and the sleeve, and placing the post and the sleeve in generally vertical position at a location on the ground where the post is to be driven. Then, the installer operates the driver to drive the post into the ground.

The method may include other steps that reflect the inventive concepts mentioned previously. For example, the sleeve may include spade means attached to a lower end portion of the sleeve for enabling a user to break the ground into which the post is to be driven, and the step of placing the post and the sleeve at a location where the post is to be driven may include the step of breaking the ground with the spade means. In addition, the spade means may include a blade member and at least one step member configured for a user to step upon in order to force the blade portion into the ground, and the step of breaking the ground with the spade means may include placing the blade member at the location where the post is to be driven and stepping upon the step member in order to make a hole in the ground with the blade member.

Furthermore, the spade means may include a blade member and two oppositely disposed step members configured for an installer to step upon in order to force the blade portion into the ground. In that case, the step of breaking the ground with the spade means may include placing the blade member at the location where the post is to be driven, stepping upon the step members in order to make a hole in the ground with the blade member, and swaying the sleeve slightly as the blade member makes a hole in the ground in order to enlarge the hole. The driver is operated somewhat conventionally, the installer moving the driver upwardly relative to the sleeve and the post and then slamming the driver downwardly so that the driver impacts an upper end of the post to thereby drive the post into the ground. Moreover, the method may proceed with a sleeve that has a length sufficient to extend from the ground to a height to which the post is to be driven and the step of operating the driver may include driving the post into the ground until an upper end of the post is substantially even with an upper end of the sleeve.

Driver operation proceeds somewhat conventionally, the installer moving the driver upwardly relative to the sleeve and the post and then slamming the driver downwardly so that the driver impacts an upper end of the post to thereby drive the post into the ground. But the method may include the step of supporting the upper portion of the post during the driving step as described previously.

The foregoing and other objects and features of the invention and the manner of attaining them will become apparent and the invention itself will be best understood by reference to the following description taken in conjunction with the accompanying illustrative drawings.

DESCRIPTION OF THE PREFERRED EMBODIMENTS

Figure 3:
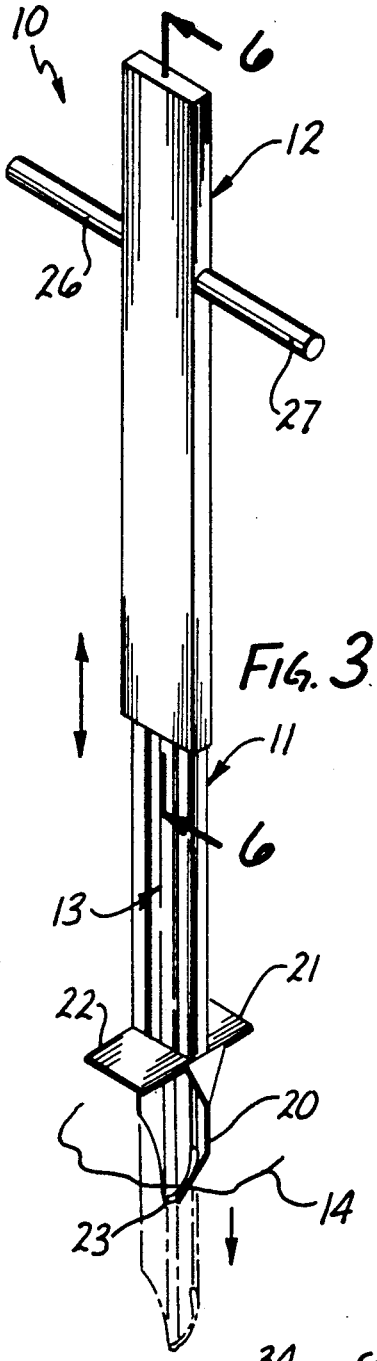
FIG. 3 is a perspective view illustrating operation of the post driver.
Figure 6:
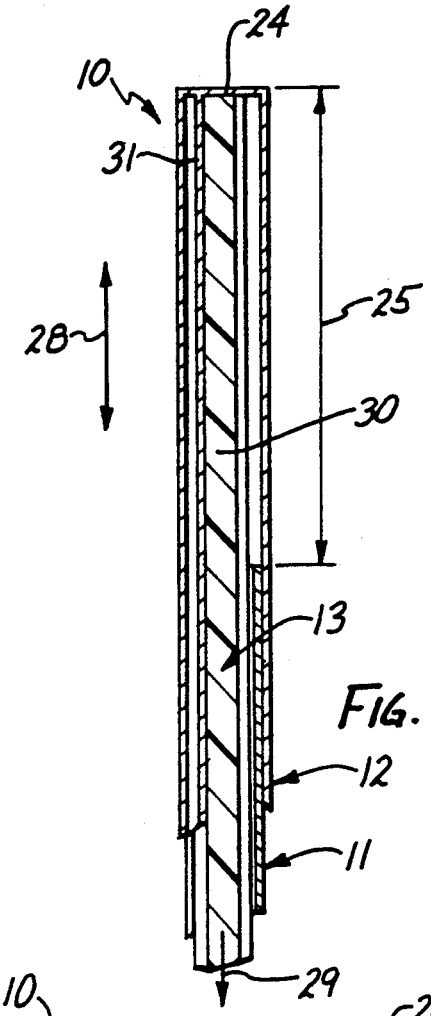
FIG. 6 is a cross sectional view of the post driver and the guidepost taken on line 6—6 of FIG. 3.
Figure 5:
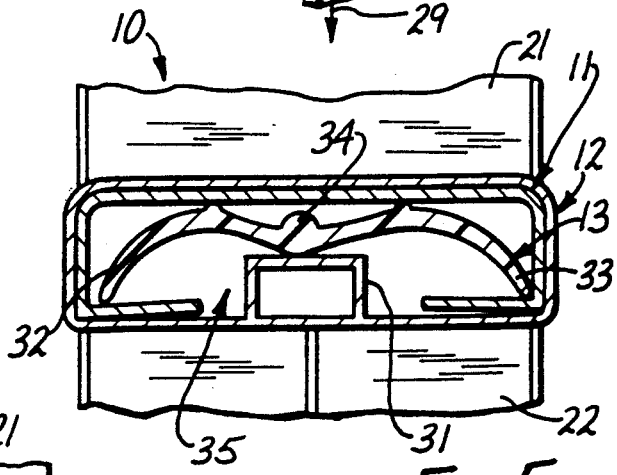
FIG. 5 is an enlarged cross sectional view similar to FIG. 4 except that the driver component is included.

Referring now to the drawings, there is shown the various steps of a method of driving a post into the ground according to the invention (FIGS. 1–6) utilizing a post driver 10 constructed according to the invention (shown assembled in FIGS. 3, 5, and 6). The post driver 10 includes a sleeve member or sleeve 11 (FIG. 1–6) and a driver member or driver 12 (FIGS. 2, 3, 5, and 6) that assemble together with a post 13 (FIGS. 1–6) that is to be driven into the ground 14 (FIGS. 1–3).

The post 13 is a flexible guidepost of the type that might be used along the highway. For that purpose, it may be extruded from a suitable thermoplastic material so that it has the illustrated gull-wing cross section (FIGS. 4 and measures about five and one-half feet long, and exhibits the physical properties required by such flexible guidepost specifications as those issue by CALTRANS of the State of California. Of course, the invention is not limited to use with such a guidepost.

In that regard, the term "post" is intended to mean any of various elongated objects that can be fixed in a somewhat vertical position, including, without limitation, any of various posts, poles, or stakes that can be installed by driving it into the ground to mark or indicate something. In addition, "driving a post into the ground" and "to be driven into the ground" means partially into the ground, the term "ground" including earth, soil, and any other substance that a post might be driven into.

Figures 1, 2:
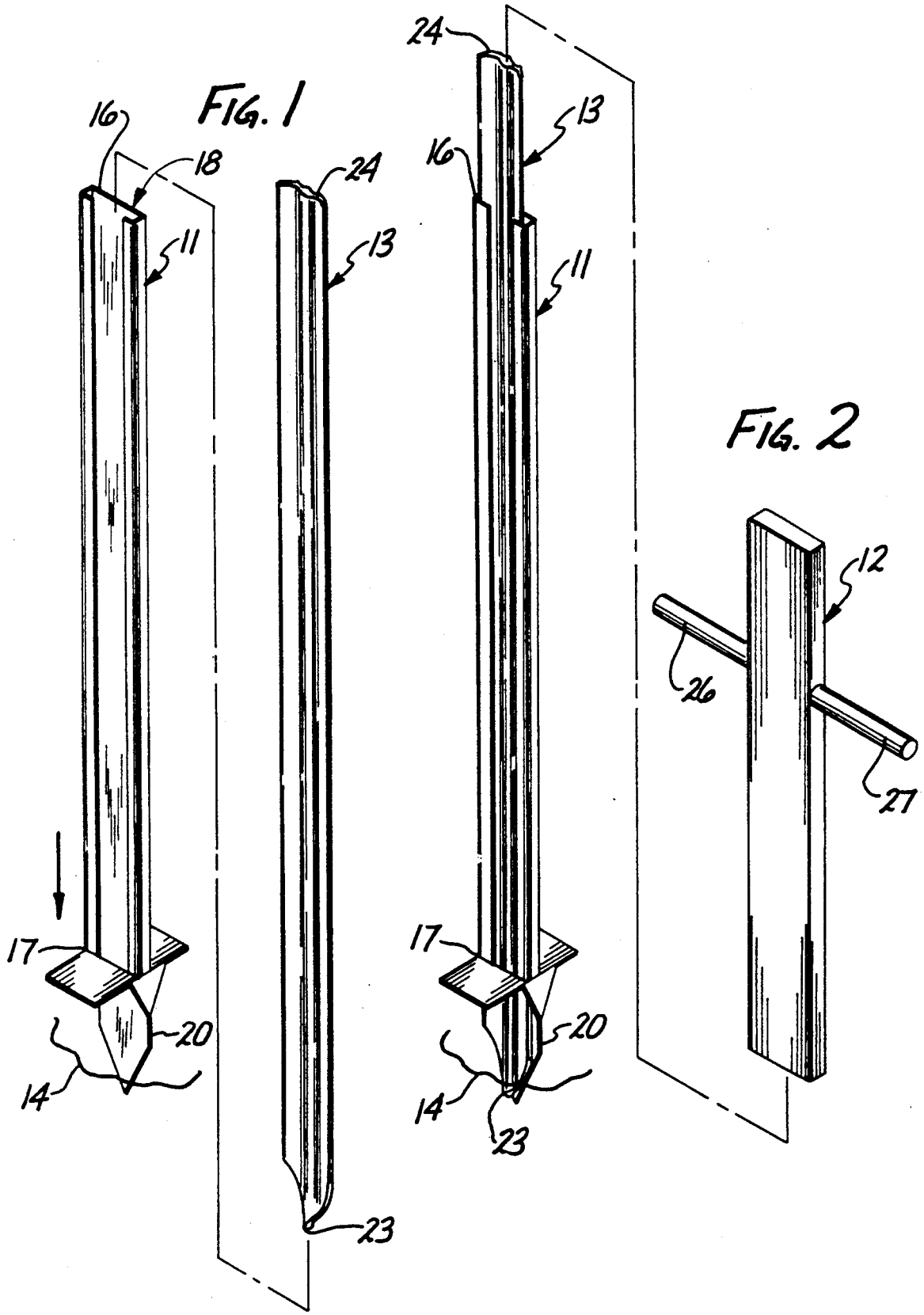
FIG. 1 the drawings is a perspective view showing placement of a flexible guidepost into the sleeve component of a pole driver constructed according to the invention.
FIG. 2 is a perspective view showing placement of the driver component over the guidepost and the containment sleeve component.

Considering the sleeve 11 in further detail, it has a first or upper end 16, a second or lower end 17, and a length between the upper and lower ends 16 and 17 sufficient to extend from the ground 14 substantially to a height to which the post 13 is to be driven (FIGS. 1 and 2). In other words, the sleeve 11 is as long as the above-ground or exposed portion of the post 13 is to be once the post 13 is fully installed (i.e., driven into the ground 14).

The sleeve 11 is an elongated member composed of a suitably strong, rigid material, such as a steel alloy. It defines a channel 18 extending between the upper and lower ends 16 and 17, the channel 18 being dimensioned and arranged to receive the post 13 so that the post 13 can slide through the channel 18 and there be supported by the sleeve 11 as the post 13 is driven into the ground 14. For that purpose, the sleeve 11 has the illustrated C-shaped cross section (FIGS. 4 and 5) that accommodates the size and shape of the post 13. Of course, those dimensions are not critical within the broader inventive concepts disclosed.

According to another aspect of the invention, the sleeve 11 includes spade means attached to the lower end 17 of the sleeve 11 for enabling a user to break the ground 14 into which the post 13 is to be driven. Preferably, the spade means includes a blade member 20 (FIGS. 1–3) that acts as a spade, the blade member 20 being composed of a suitably strong, rigid material such as steel and suitably attached to the sleeve 11, either integrally in one-piece construction or as a separate attached part. In addition, the spade means includes at least one and preferably two step members 21 and 22 that are configured for a user to step upon in order to force the blade member 20 into the ground 14 (FIGS. 1–5).

The post 13 may first be inserted into the channel 18, feeding a lower end 23 of the post 13 into the channel 18 at the upper end 16 of the sleeve 11 (FIG. 1). Then, with the sleeve 11 held generally vertically at a location where the post 13 is to be driven into the ground 14, as shown in FIG. 3, the user steps on one or both of the step members 21 and 22. While that is done, the user may sway the sleeve 11 slightly from side to side. That helps the spade member 20 break the ground 14 and form a hole as the spade member 20 moves to the position illustrated in phantom lines in FIG. 3. It also helps enlarge the hole slightly in order to facilitate movement of the post 13 into the ground 14 so that the lower end 23 of the post 13 extends into the ground 14 about as far as the blade member 20 does as illustrated in FIG. 2.

That leaves an upper end 24 of the post 13 exposed or extending beyond the upper end 16 of the sleeve 11 as shown in FIGS. 2 and 6, the distance between the upper end 24 of the post 13 and the upper end 16 of the sleeve 11 depicted by the arrow 25 in FIG. 6 being the distance the post 13 must yet be driven into the ground 14. The post 13 is driven that additional distance by placing the driver 12 over the upper end 24 of the post 13 so that the driver rests upon the upper end 24 and extends downwardly over the sleeve 11. Then, grasping handles 26 and 27 on the driver 12 (FIGS. 2 and 3), the user moves the driver 12 upwardly and slams it downwardly as depicted by an arrow 28 in FIG. 6, the impact of the driver 12 on the upper end 24 of the post 13 causing the post 13 to move in the direction of an arrow 29 in FIG. 6 as it is driven into the ground 14. When the upper end 24 of the post 13 is even with the upper end 16 of the sleeve 11, the post 13 is at the predetermined height to which it is to be driven. Then, the driver 12 and the sleeve 11 are removed, leaving the post 13 installed in the ground 14 at just the right height.

Thus, the sleeve 11 contains or supports the post 13 all the way to the ground 14. However, the sleeve 11 does not support an upper portion 30 of the post 13 exposed above the upper end 16 of the sleeve 11 (FIGS. 2 and 6), and support is desirable because the driver 12 is composed of a suitably strong, rigid material such as steel and it is somewhat heavy to facilitate the driving operation. As a result, the impact of the driver 12 on the post 13 tends to cause the upper portion 30 to bend and buckle while the upper portion 30 it is above the upper end 16 of the sleeve 11.

So, according to another aspect of the invention, the driver 12 is configured to support the upper portion 30 of the post 13. In other words, the driver 12 includes means for supporting the upper portion 30 of the post 13 (FIG. 6) as the post 13 is driven into the ground 14 with the driver 12. That is accomplished in the illustrated embodiment with an inwardly extending rib 31 attached to the driver 12 (FIGS. 5 and 6), the rib 31 extending toward the upper portion 30 of the post 13 as the post 13 is driven into the ground with the driver 12.

Figure 4:
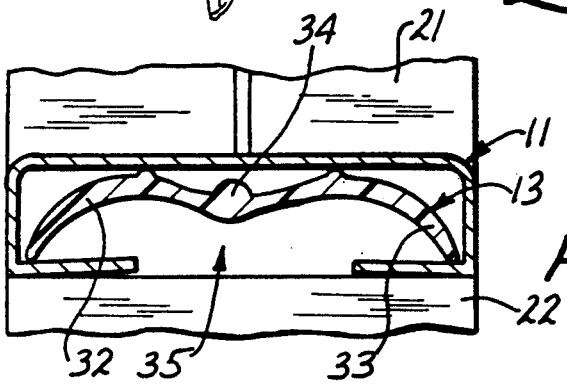
FIG. 4 is an enlarged cross sectional view of the sleeve component taken in a horizontal plane.

More specifically, the post 13 includes a left marginal edge portion or gullwing 32, a right marginal edge portion or gullwing 33, and a central portion or main body 34 (FIGS. 4 and 5). The gullwings 32 and 33 are supported within the channel 18 by the sleeve 11 and above the sleeve 11 by the driver 12, but the main body 34 is unsupported except for the support contributed by the rib 31. However, the rib 31 bears against the main body 34 of the post 13 to provide the needed support.

The driver 12 is dimensioned and arranged to slide over the sleeve 11 in order to drive the post 13 through the channel 18 into the ground 14. As the driver 12 moves telescopingly downwardly over the sleeve 11, the rib 31 extends through a vertically extending slot 35 existing in the sleeve 11 by virtue of the C-shaped cross section employed. Thus, the sleeve 11 and the driver 12 combine to support substantially the full length of the post 13 above the ground 14, and that significantly improves performance in terms of better driving ability coupled with less damage to the post 13.

Thus, the invention provides a post driver that includes both a containment sleeve and an overdriver. Properly configured, those components provide support to substantially the full length of the post above ground. As a result, the post driver helps prevent buckling and bending. It also helps keep the post from becoming stuck in the driver. It involves easily operated components that work without a separately formed pilot hole, and it can be used to provide automatic height control.

Although an exemplary embodiment of the invention has been shown and described, many changes, modifications, and substitutions may be made by one having ordinary skill in the art without necessarily departing from the spirit and scope of the invention.

What is claimed is:

1. A post driver apparatus, comprising:

means defining a sleeve for supporting a post as the post is driven into the ground;

means defining a driver for driving the post into the ground while the post is supported by the sleeve;

the sleeve defining a channel that is dimensioned and arranged to receive the post so that the post can slide through the channel as the post is driven into the ground;

the driver being dimensioned and arranged to slide over the sleeve in order to drive the post through the channel into the ground;

said driver including means for supporting an upper portion of the post as the post is driven into the ground with the driver; and said means for supporting including an inwardly extending rib attached to the driver, the rib extending toward the upper portion of the post as the post is driven into the ground with the driver.

2. A apparatus as recited in claim 1, wherein the sleeve has a length sufficient to extend from the ground substantially to a height to which the post is to be driven.

3. An apparatus as recited in claim 1, wherein the sleeve includes spade means attached to a lower end portion of the sleeve for enabling a user to break the ground into which the post is to be driven.

4. An apparatus as recited in claim 3, wherein the spade means includes a blade member and at least one step member configured for a user to step upon in order to force the blade member into the ground.

5. An apparatus as recited in claim 1, wherein the sleeve has a C-shaped cross section, the rib extending into the channel when the driver is placed telescopingly over the sleeve.

6. A post driver apparatus, comprising:

means defining a sleeve for supporting a post as the post is driven into the ground;

means defining a driver for driving the post into the ground while the post is supported by the sleeve;

the sleeve having a length sufficient to extend from the ground to a height to which the post is to be driven;

the sleeve having a C-shaped cross section and defining a channel that is dimensioned and arranged to receive the post so that the post can slide through the channel as the post is driven into the ground;

the sleeve including spade means attached to a lower end portion of the sleeve for enabling a user to break the ground into which the post is to be driven;

the spade means including a blade member and at least one step member configured for a user to step upon in order to force the blade portion into the ground;

the driver being dimensioned and arranged to slide over the sleeve in order to drive the post through the channel into the ground; and the driver including means for supporting an upper portion of the post as the post is driven into the ground with the driver, said means for supporting an upper portion of the post including an inwardly extending rib attached to the driver, the rib extending toward the upper portion of the post as the post is driven into the ground with the driver.

7. A post driver apparatus for driving a post into the ground, said apparatus comprising:

an elongated sleeve adapted to slidably receive the post so the post can be driven relative to the sleeve and into the ground;

a driver telescoped over the sleeve so that the driver can be moved longitudinally of the sleeve; and said driver having a driving surface for striking the upper end of the post to drive the post into the ground as the driver is moved longitudinally on the sleeve.

8. An apparatus as described in claim 7 wherein the sleeve has a lower end and the apparatus includes means adjacent the lower end of the sleeve for entering the ground.

9. An apparatus as described in claim 7 wherein the sleeve has an upper end which serves as a stop to control the extent to which the post can be driven into the ground and the height of the post above the ground.

10. An apparatus as described in claim 7 including cooperating means on the sleeve and driver for supporting an upper portion of the post as the post is driven into the ground.

11. An apparatus as described in claim 7 wherein the sleeve has a longitudinally extending slot and the driver has a post support member which extends through the slot and which is engageable with the post to support the post.

12. An apparatus as described in claim 11 wherein the sleeve has an elongated channel extending longitudinally through the sleeve for receiving the post, said sleeve having a rear wall, opposite end walls coupled to the rear wall and first and second flanges joined to the end walls and extending toward each other to define said slot, said walls guiding and supporting the post, said slot extending to the upper end of the sleeve, a blade coupled to a lower end of the sleeve, said post support member being elongated in the direction of elongation of the sleeve, said driver having a closed upper end defining the driving surface and handles on the driver for moving the driver on the post.

13. A method of driving a post into the ground comprising:

providing a post having an upper end with the post being within an elongated sleeve and with the sleeve slidably receiving the post so the post can be driven relative to the sleeve and into the ground;

telescoping a driver having a driving surface over the sleeve and post; and moving the driver longitudinally on the sleeve to cause the driving surface to strike the upper end of the post to drive the post relative to the sleeve and into the ground.

14. A method as described in claim 13 wherein the sleeve has a lower end, the apparatus includes a member adjacent the lower end adapted to enter the ground and including forcing the member into the ground.

15. A method as described in claim 14 wherein the step of forcing includes forming a hole in the ground with the member and the method includes swaying the sleeve to form an enlarged hole in the ground and placing a lower end of the post in the enlarged hole.

16. A method as described in claim 13 wherein the sleeve has a length sufficient to extend from the ground to a height to which the post is to be driven and the step of moving the driver includes driving the post into the ground until an upper end of the post is substantially even with an upper end of the sleeve.

17. A method as described in claim 13 wherein the post is flexible and includes a center main body and first and second gullwing portions coupled to the main body and including supporting the gullwing portions of upper and lower regions of the post with the driver and sleeve, respectively, during said step of moving and supporting upper regions of the central main body with a post support member on the driver during said step of moving.

18. A method as described in claim 13 including supporting the full length of the post which is above ground with the sleeve and driver.

* * * * *

UNITED STATES PATENT AND TRADEMARK OFFICE

CERTIFICATE OF CORRECTION

PATENT NO. : 5,020,605

DATED : June 4, 1991

INVENTOR(S) : Layne S. Leishman

It is certified that error appears in the above-identified patent and that said Letters Patent is hereby corrected as shown below:

Column 2, line 32 after "driven" insert a period.

Column 3, line 44 after "l" insert -- of --.

Column 3, line 46 change "pole" to -- post --.

Column 4, line 8 after "4 and" insert -- 5), --.

Column 8, line 36 change "center" to -- central --.

Signed and Sealed this

Twenty-ninth Day of December, 1992

*Attest:*

DOUGLAS B. COMER

*Attesting Officer*

*Acting Commissioner of Patents and Trademarks*